US010682698B2

(12) United States Patent
Joo et al.

(10) Patent No.: US 10,682,698 B2
(45) Date of Patent: Jun. 16, 2020

(54) METAL-CARBON NANOFIBER AND PRODUCTION METHOD THEREOF

(71) Applicant: SEOUL NATIONAL UNIVERSITY R&DB FOUNDATION, Seoul (KR)

(72) Inventors: Young Chang Joo, Seoul (KR); Dae Hyun Nam, Seoul (KR); Ji Hoon Lee, Gyeongsangnam-do (KR); Na Rae Kim, Seoul (KR); Yoo Yong Lee, Gyeonggi-do (KR); Han Wool Yeon, Seoul (KR); So Yeon Lee, Gyeonggi-do (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 265 days.

(21) Appl. No.: 15/744,280

(22) PCT Filed: Jul. 28, 2015

(86) PCT No.: PCT/KR2015/007852
§ 371 (c)(1),
(2) Date: Jan. 12, 2018

(87) PCT Pub. No.: WO2017/018556
PCT Pub. Date: Feb. 2, 2017

(65) Prior Publication Data

US 2018/0200788 A1 Jul. 19, 2018

(51) Int. Cl.
*B22F 1/00* (2006.01)
*D01F 9/21* (2006.01)
(Continued)

(52) U.S. Cl.
CPC ..... *B22F 1/0085* (2013.01); *B22F 1/0025* (2013.01); *B22F 1/02* (2013.01);
(Continued)

(58) Field of Classification Search
CPC ..... B22F 1/0025; D01D 1/02; D01D 5/0007; C22C 47/00
See application file for complete search history.

(56) References Cited

U.S. PATENT DOCUMENTS

2012/0100303 A1* 4/2012 Kim ..... B82Y 30/00 427/553
2013/0126794 A1* 5/2013 Lee ..... D01D 5/0007 252/506

FOREIGN PATENT DOCUMENTS

KR 10-2012-0005403 A 1/2012
KR 10-20120091792 A 2/2012
(Continued)

OTHER PUBLICATIONS

Nam, Dae-Hyun, Ji-Hoon Lee, Na-Rae Kim, Yoo-Yong Lee, Han-Wool Yeon, So-Yeon Lee, and Young-Chang Joo. "One-step structure modulation of electrospun metal-loaded carbon nanofibers: Redox reaction controlled calcination." Carbon 82 (2015): 273-281. Published Oct. 29, 2014 (Year: 2014).*

*Primary Examiner* — Anthony J Zimmer
*Assistant Examiner* — Ricardo D Morales
(74) *Attorney, Agent, or Firm* — Stuart H. Mayer; Mayer & Williams PC

(57) ABSTRACT

The present invention provides a production method of copper-carbon nanofibers, which can realize oxidation-resistant characteristics and process simplification, the production method comprising the steps of: forming a metal precursor-organic nanofiber comprising a metal precursor and an organic substance; and forming a metal-carbon nanofiber by performing a selective oxidation heat treatment to the metal precursor-organic nanofiber so as to simultaneously oxidize carbon of the organic substance and reduce the metal precursor to a metal, wherein the metal has a lower oxidation resistance than the carbon; the selective oxidation
(Continued)

heat treatment is performed through a singly heat treatment step, not a plurality of heat treatment steps; and metal-carbon nanofibers with different structures may be formed according to the amount of partial oxygen pressure under which the selective oxidation heat treatment is performed.

14 Claims, 11 Drawing Sheets

(51) Int. Cl.

| | |
|---|---|
| ***D01D 5/00*** | (2006.01) |
| ***D01D 1/02*** | (2006.01) |
| ***D01F 1/10*** | (2006.01) |
| ***B22F 1/02*** | (2006.01) |
| ***B22F 9/30*** | (2006.01) |
| ***D01F 9/14*** | (2006.01) |
| ***D01F 6/14*** | (2006.01) |
| ***D01D 10/02*** | (2006.01) |
| ***C22C 1/04*** | (2006.01) |
| ***C22C 47/14*** | (2006.01) |
| ***B22F 9/22*** | (2006.01) |
| ***D01F 11/00*** | (2006.01) |

(52) U.S. Cl.

CPC ..... *B22F 1/025* (2013.01); *B22F 9/30* (2013.01); *D01D 1/02* (2013.01); *D01D 5/003* (2013.01); *D01D 5/0007* (2013.01); *D01F 1/10* (2013.01); *D01F 9/14* (2013.01); *D01F 9/21* (2013.01); *B22F 9/22* (2013.01); *B22F 2301/10* (2013.01); *B22F 2304/05* (2013.01); *B22F 2999/00* (2013.01); *C22C 1/0425* (2013.01); *C22C 47/14* (2013.01); *D01D 10/02* (2013.01); *D01F 6/14* (2013.01); *D01F 11/00* (2013.01); *D10B 2101/12* (2013.01); *D10B 2101/20* (2013.01)

(56) References Cited

FOREIGN PATENT DOCUMENTS

| | | | |
|---|---|---|---|
| KR | 10-2012-0043562 | A | 5/2012 |
| KR | 10-2014-0127541 | A | 11/2014 |
| KR | 10-2015-0107262 | A | 9/2015 |

* cited by examiner

METAL-CARBON NANOFIBER AND PRODUCTION METHOD THEREOF

STATEMENT REGARDING GOVERNMENT RIGHTS

The present invention was made with the support of National Strategic R&D Program of the National Research Foundation (NRF) & the Korean government (Ministry of Science and ICT(MSIT)) (No. 1711093162).

TECHNICAL FIELD

The present disclosure relates to nanofibers and a method for producing the same, and more particularly, to metal-carbon nanofibers and a method for producing the same.

BACKGROUND ART

Since having a high ratio of surface area per volume, the nanostructures may exhibit more excellent characteristics compared to general materials in energy, electronic, chemical, and environmental applications. Nanostructures are classified into 0D structures to 2D structures according to the structures thereof, and particularly, 1D nanostructures have varying conductive characteristics according to the aspect ratios thereof. In particular, electrical characteristics of the 1D nanostructure are affected by own resistance of the structures and contact resistance between the structures, and the longer and thinner the 1D structure, the better the electrical conductivity. The electrical conductivity mechanism of the 1D nanostructure is based on the percolation theory. More specifically, the longer the nanostructure, the smaller the number of contacts present in series within a certain distance. In addition, the thinner the nanostructure, the greater the number of contacts present in parallel within the certain distance, and according to such serial or parallel distribution, an effect of inducing reduction of total resistance may be achieved. When classified according to aspect ratios, the 1D nanostructures may be classified into nanorods, nanowires, and nonfibers. Among these, since their own thicknesses and lengths of the nanowires are determined by a concentration of solute in a solution, there is a limitation in that aspect ratios the nanowires cannot be easily adjusted. In addition, since the own lengths of the nanowires are also at a level of 10 micrometers, the aspect ratios are not large and the nanowires show a limitation in an aspect of their own electrical conductivity.

From this background, among the 1D nanostructures, nanofibers which are produced by electrospinning may realize the highest aspect ratio. Nanofibers are important in that a solution that can solve the limitation of existing nanowires may be provided thereby. Nanofibers are produced through electrospinning. Electrospinning is a method for producing nanofibers on the basis of a solution and has a merit in that a great amount of nanostructures may be produced at a low process cost. In the electospinning, nanofibers are produced through a method in which a high voltage of several tens of KV is applied to a solution to induce electrostatic repelling force, and in this state, a syringe is pressed by means of a pump. In particular, the thicknesses of nanofibers may simply be adjusted by adjusting the voltage applied to the solution, and since the lengths thereof are also greater than 100 μm, the aspect ratios thereof are also large. In addition, characteristics of the nanofibers may be improved through the alignment of nanofibers. Basically, the solution used for electrospinning is composed of polymer matrices and a solvent for forming nanofibers. To produce nanofibers including a material such as a semiconductor, a precursors or nanoparticles should be dissolved together into an existing solution. After the electrospinning, the compositions, phases, and structures of materials included in nanofibers may be controlled through a subsequent calcination process.

DISCLOSURE OF THE INVENTION

Technical Problem

The present invention provides metal-carbon nanofibers and a method for producing the same. These carbon nanofibers themselves exhibit electrical conductivity, and may be applied according to the kind of metals in various fields, such as fields of energy, electronics, sensors, and catalysts. For producing a metal-carbon nanofiber, a subsequent heat treatment process is required to be performed onto the nanofibers composed of metal precursors and polymer matrices just after electrospinning. The present invention provides a method for controlling conditions in the subsequent heat treatment process and various types of metal-carbon nanofibers produced according to the method.

To enhance the functionality of nanofibers, a technique of forming a secondary structure including core/shell, hollow, and porous structures, and various materials on the nanofibers as composites is required. First, in the case of the secondary structure, inner and outer materials of the core/shell are configured to be different from each other, and thus, a dual characteristic may be achieved. In addition, the hollow and porous structures have merits in that the surface areas of nanofibers may be increased compared to existing nanofibers. These may be produced by using coaxial electrospinning. The coaxial electrospinning is a production method in which a syringe filled with various kinds of solutions is used for simultaneous pumping, and conditions such as miscibility between the solutions and volatility of a solvent should be controlled according to the types of the secondary structure. Composites of materials have merits of making it possible to combine various materials, such as metals, semiconductors, polymers, carbon-based materials and achieving characteristics according to the types of materials. The composites of materials may be produced through a gas-solid reaction, a sol-gel method, a direct-dispersion method, an in-situ photoreduction method, or the like. These existing methods for forming the secondary structure and composite materials have a limitation in that the processes themselves are sensitive to external conditions and complicated. In addition, there is no efficient producing method in which both the two existing methods may be simultaneously implemented. In addition, since raw materials required for producing each of the structures and composite materials are different, practicality is degraded.

To resolve various limitations including the above-mentioned limitations, the present invention includes a method in which secondary structures and composite materials of nanofibers may be simultaneously achieved and various structures produced according to the method. In particular, processes are systematized through a control of parameters for oxygen partial pressures in subsequent heat treatment, and the structure and characteristics of metal-carbon nanofibers formed according to each of the conditions are provided. In addition, in existing arts, a two-step heat-treatment process of oxidation and reduction was required to produce metal nanofibers. The nanofibers produced by such processes are sequentially subjected to the two-step heat-treatment of oxidation and reduction which are opposite to each other, and the nanofibers may therefore undergo severe thermal damage. A subsequent heat treatment method provided in the present invention may reduce the existing two-step heat treatment process into one step and thus also has excellent process efficiency.

The purpose of the present invention is to solve various limitations including the above-mentioned limitations. However, this may be merely illustrative, and thus the present disclosure is not limited thereto.

Technical Solution

According to an aspect of the present invention, a method for producing a metal-carbon nanofiber is provided. The method includes the steps of: forming a metal precursor-organic nanofiber comprising a metal precursor and an organic substance; and forming a metal-carbon nanofiber by performing a selective oxidation heat treatment onto the metal precursor-organic nanofiber such that carbons in the organic substance are oxidized and the metal precursor is reduced into a metal, wherein the metal has lower oxidation reactivity than carbon; the selective oxidation heat treatment is performed not in a plurality of heat treatment steps but in one heat treatment step; and the metal-carbon nanofiber having structures different from each other may be produced according to oxygen partial pressures and/or time for performing the selective oxidation heat treatment.

In the method for producing metal-carbon nanofibers, the metal may include copper, nickel, cobalt, iron, or silver which is a metal having lower oxidation reactivity than carbon.

In the method for producing metal-carbon nanofibers, the selective oxidation heat treatment may be performed in an atmosphere of a first oxygen partial pressure to a second oxygen partial pressure; and when the metal precursor-organic nanofiber is heat treated in an atmosphere of an oxygen partial pressure lower than the first oxygen partial pressure, metals of the metal precursor may be reduced and carbons of the organic substance may also be reduced; and when the metal precursor-organic nanofiber is heat treated in an atmosphere of an oxygen partial pressure higher than the second oxygen partial pressure, metals of the metal precursor may be oxidized and carbons of the organic substance may also be oxidized.

In the method for producing metal-carbon nanofibers, when the metal precursor-organic nanofibers are heat-treated under an atmosphere of an oxygen partial pressure from the first oxygen partial pressure to the second oxygen partial pressure, carbons in the metal precursor-organic nanofibers may be oxidized and the remaining carbons may support the structures of the metal precursor-organic nanofibers; and when the metal precursor-organic nanofibers are heat-treated under an atmosphere of a higher oxygen partial pressure than the second oxygen partial pressure, carbons in the metal precursor-organic nanofibers may be oxidized and the remaining carbons may not support the structures of the metal precursor-organic nanofibers.

In the method for producing a metal-carbon nanofiber, the selective oxidation heat treatment may be performed in an atmosphere of an oxygen partial pressure less than a third oxygen partial pressure which is greater than or equal to the first oxygen partial pressure and less than the second oxygen partial pressure; and when the metal precursor-organic nanofiber is heat treated in an atmosphere of an oxygen partial pressure greater than or equal to the third oxygen partial pressure, a hollow hole may be generated inside the metal-carbon nanofiber by diffusion of carbon according to a concentration gradient of residual carbons which remain after carbons in the copper precursor-organic nanofiber are oxidized; and the metal-carbon nanofiber formed by performing the selective oxidation heat treatment in an atmosphere of an oxygen partial pressure, which is greater than or equal to the first oxygen partial pressure and less than the third oxygen partial pressure, may have a structure in which metal particles are uniformly distributed inside a base material and on an outer surface of a fibrous carbon body without a hollow hole.

In the method for producing a metal-carbon nanofiber, the selective oxidation heat treatment may be performed in an atmosphere of an oxygen partial pressure less than a fourth oxygen partial pressure which is greater than or equal to the third oxygen partial pressure and less than the second oxygen partial pressure; and when the metal precursor-organic nanofiber is heat treated in an atmosphere of an oxygen partial pressure greater than or equal to the fourth oxygen partial pressure, a hollow hole may be generated inside the metal-carbon nanofiber by diffusion of carbon according to a concentration gradient of residual carbons which remain after carbons in the copper precursor-organic nanofiber are oxidized, and metals in the metal-carbon nanofiber may be diffused not only to a core but also to an outer surface of the metal-carbon nanofiber; and the metal-carbon nanofiber formed by performing the selective oxidation heat treatment in an atmosphere of an oxygen partial pressure, which is greater than or equal to the third oxygen partial pressure and less than the fourth oxygen partial pressure, may have a core-shell structure in which metal particles form the core and carbons form a shell surrounding the core.

In the method for producing a metal-carbon nanofiber, the selective oxidation heat treatment may be performed in an atmosphere of an oxygen partial pressure less than a fifth oxygen partial pressure which is greater than or equal to the fourth oxygen partial pressure and less than the second oxygen partial pressure; and when the metal precursor-organic nanofiber is heat treated in an atmosphere of an oxygen partial pressure greater than or equal to the fifth oxygen partial pressure, a hollow hole may be generated inside the metal-carbon nanofiber by diffusion of carbon according to a concentration gradient of residual carbons which remain after carbons in the copper precursor-organic nanofiber are oxidized, and a portion of an outer surface of the metal-carbon nanofiber may be thinned and ruptured; and the metal-carbon nanofiber formed by performing the selective oxidation heat treatment in an atmosphere of an oxygen partial pressure, which is greater than or equal to the fourth oxygen partial pressure and less than the fifth oxygen partial pressure, may have structure in which metal particles are distributed inside a base material and an outer surface of a tubular carbon body defining the hollow hole, and inside the hollow hole.

In the method for producing a metal-carbon nanofiber, the selective oxidation heat treatment may be performed in an atmosphere of an oxygen partial pressure which is greater than or equal to the fifth oxygen partial pressure and less than the second oxygen partial pressure; and the metal-carbon nanofiber formed by performing the selective oxidation heat treatment on the metal precursor-organic nanofiber in an atmosphere of an oxygen partial pressure, which is greater than or equal to the fifth oxygen partial pressure and less than the second oxygen partial pressure, may have a structure in which carbons in the metal precursor-organic nanofiber is oxidized, a hollow hole may be formed by a concentration gradient of remaining carbons, a portion of an outer surface of the metal-carbon nanofiber may be thinned and ruptured, and metals may be distributed in an outer surface of a carbon body and in the hollow hole.

In the method for producing a metal-carbon nanofiber, the selective oxidation heat treatment may be induced not only by pressures but also by a time period. A structure in which metal particles are uniformly distributed inside the base material and the outer surface of a fibrous carbon body without a hollow hole; a core-shell structure in which metals form a core and carbons form a shell surrounding the metals; a structure in which metal particles are distributed inside a base material and on the surface of the tubular carbon body defining a hollow hole and inside the hollow hole; and a structure, in which a hollow hole is formed inside a nanofiber, a portion of the outer surface of the metal-carbon nanofiber is thinned and ruptured, and metals are distributed on the outer surface of a carbon body and inside the hollow hole, may be formed in said order. This tendency may vary in structure formation speeds according to pressures. The hollow holes may be formed at a higher speed under a high pressure, and the higher the pressure, the quicker the four structures may be formed in the metal-carbon nanofiber. This is because the higher the pressure, the more the amount of decomposed carbon for the same time period, and a concentration gradient is increased such that the amount of carbon diffused to the outside increases and the hollow hole is more quickly formed.

In the method for producing a metal-carbon nanofiber, the metal precursor may include copper acetate ($Cu(CH_3COO)_2$) which is a copper precursor, and the organic substance may include polyvinylalcohol (PVA) forming a hydrogen bond with the copper acetate.

In the method for producing a metal-carbon nanofiber, the step of forming a metal-carbon nanofiber by performing the selective oxidation heat treatment on the metal precursor-organic nanofiber such that carbons in the organic substance is oxidized and the metal precursor is reduced to a metal may include a step of performing auto-reduction onto the copper precursor using, as a reducing agent, carbon monoxide (CO) generated from an acetate functional group of the copper precursor by the selective oxidation heat treatment.

In the method for producing a metal-carbon nanofiber, the step of forming a metal-carbon nanofiber by performing the selective oxidation heat treatment on the metal precursor-organic nanofiber may include a step of decomposing a portion of carbons constituting the metal precursor-organic nanofiber not by pyrolysis but by combustion.

According to another aspect of the present invention, a method for producing a metal-carbon nanofiber may be provided. The metal-carbon nanofiber may be obtained by the above-mentioned producing method.

Advantageous Effects

As described above, according to an example of the present invention, a method for producing metal-carbon nanofibers, by which oxidation resistance characteristics and process simplification can be achieved, may be provided. A secondary structure for improving functionality of the nanofiber and a composite material may be simultaneously obtained through a process parameter control. Various performances may be achieved according to the structure of the metal-carbon nanofiber formed by the present process, and thus, the metal-carbon nanofiber formed by the present process may be applied to various fields. Of course, the scope of the present invention is not limited by such effects. Existing methods for forming composite materials have limitations in that process itself is sensitive to an external condition and is complicated. In addition, there is no efficient producing method in which both the two methods may be implemented together. In addition, since raw materials required for producing each of the structures and composite materials are different, practicality is degraded.

MODE FOR CARRYING OUT THE INVENTION

Figure 1:
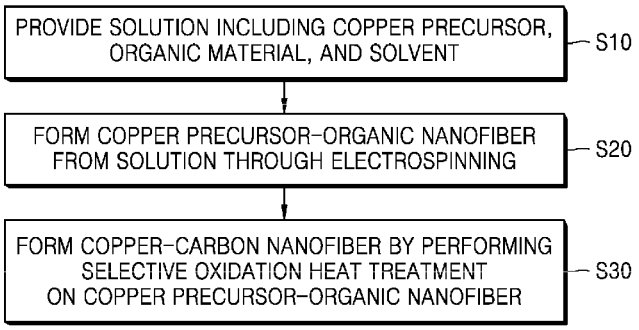
FIG. 1 is a flowchart illustrating a method for producing metal-carbon nanofibers according to examples of the present invention.

Hereinafter examples of the present invention will be described in detail with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. In addition, in the figures, the sizes of components may be exaggerated or contracted for convenience of description.

A method of producing metal-carbon nanofibers according to the technical idea of the present invention, includes: forming a metal precursor-organic nanofiber including a metal precursor and an organic substance; and forming a metal-carbon nanofiber by performing a selective oxidation heat treatment onto the metal precursor-organic nanofiber so as to simultaneously oxidize carbons of the organic substance and reduce the metal precursor into a metal, wherein the metal has lower oxidation resistance than carbon; the selective oxidation heat treatment is performed not through a plurality of heat treatment steps but through a single heat treatment step.

The selective oxidation heat treatment is performed in an atmosphere of a first oxygen partial pressure to a second oxygen partial pressure, and in particular, metal-carbon nanofibers with different structures may be formed according to the magnitude of partial oxygen pressure under which the selective oxidation heat treatment is performed. Described below is the reference for the first oxygen partial pressure and the second oxygen partial pressure.

When the metal precursor-organic nanofibers are heat-treated under an atmosphere of a lower oxygen partial pressure than the first oxygen partial pressure, metals of the metal precursor are reduced, and carbons of the organic substance are also reduced.

When the metal precursor-organic nanofibers are heat-treated under an atmosphere of a higher oxygen partial pressure than the second oxygen partial pressure, the metals of the metal precursor are oxidized, and the carbons of the organic substance are also oxidized.

When the metal precursor-organic nanofibers are heat-treated under an atmosphere of the first oxygen partial pressure to the second oxygen partial pressure, carbons in the metal precursor-organic nanofibers may be oxidized and the remaining carbons may support the structures of the metal precursor-organic nanofibers. However, when the metal precursor-organic nanofibers are heat-treated under an atmosphere of a higher oxygen partial pressure than the second oxygen partial pressure, carbons in the metal precursor-organic nanofibers may be oxidized and the remaining carbons may not support the structures of the metal precursor-organic nanofibers.

The above-mentioned metal should have lower oxidation reactivity than carbon, for example, the metal may include copper, nickel, cobalt, iron or silver. Hereinafter for convenience of description, various examples of the case in which the metal is copper will be described. However, the technical idea of the present invention may be applied not only to copper but also to an arbitrary metal having lower oxidation reactivity than carbon.

FIG. 1 is a flowchart illustrating a method for producing metal-carbon nanofibers according to examples of the present invention.

Referring to FIG. 1, a method for producing metal-carbon nanofibers according to examples of the present invention includes: providing a solution containing a copper precursor, an organic substance and a solvent (S10); forming a copper precursor-organic nanofiber from the solution through electrospinning using electrostatic repulsion formed by applying a high voltage to the solution (S20); and forming copper-carbon nanofiber by performing selective oxidation onto the copper precursor-organic nanofiber so as to oxidize carbons of the organic substance and simultaneously reduce the copper precursor into copper. Particularly, the selective oxidation heat treatment is performed not through a plurality of heat treatment steps but through a single heat treatment step.

Figure 2:
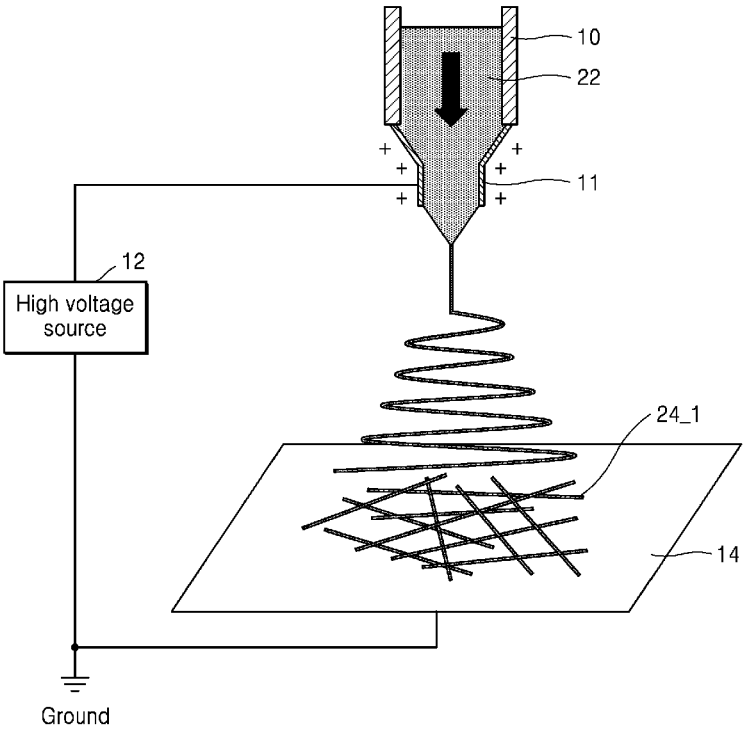
FIG. 2 is a view illustrating a step of forming copper precursor-organics nanofiber through electrospinning in a method for producing copper-carbon nanofibers according to some examples of the present invention.

FIG. 2 is a view illustrating a step of forming copper precursor-organic nanofiber through electrospinning in a method for producing copper-carbon nanofibers according to some examples of the present invention.

Referring to FIG. 2, a solution 22 produced by mixing a metal precursor, an organic substance, and a solvent is added into a syringe 10 for electrospinning. Electrospinning is a simple and highly efficient method of making a nanofiber 24_1 using electrostatic repulsion by applying a high voltage to the solution 22. The solution 22 used to form the nanofiber 24_1 may include: a metal solid solution such as a metal precursor; an organic matrix (organic substance); and a solvent.

A metal solid solution is a material which includes ions of the metal nanofibers to be produced, and a combination between a functional group in the solid solution and an organic matrix is important. Therefore, it may be desirable to select materials having functional groups of the same or similar kind and to uniformly distribute the metal solid solution. For example, the metal precursor may include copper acetate ($Cu(CH_3COO)_2$) to produce a copper nanofiber.

The organic substance, i.e., an organic matrix, serves as a backbone of a nanofiber 24_1 initially formed through electrospinning. For example, in order to produce a copper nanofiber, an organic matrix may form a hydrogen bond with an acetate group (—$CH_3COO$—) of copper acetate (CuAc)) and include a poly vinyl alcohol (PVA) having a relatively low decomposition temperature.

In addition, the solvent should be able to dissolve both the metal solid solution and the organic matrix. For example, in order to make a copper nanofiber, distilled water may be used as the solvent because the solubility of the copper acetate and the poly vinyl alcohol with respect to water is relatively high.

For example, the copper precursor-organic nanofiber 24_1 is produced through electrospinning in which a fiber is formed by applying an electrostatic repulsion to the solution. When a subsequent heat treatment (calcination) of oxidation and reduction is applied to the copper precursor-organic nanofiber 24_1 formed by electrospinning, the copper-carbon nanofiber can be obtained. In electrospinning, the thickness of the generated nanofiber may be simply adjusted according to the magnitude of a voltage which approaches several tens of kV and is applied to the solution 22, and a length of 100 μm or more may also be obtained. Furthermore, the present invention has the advantage of improving the permeability and conductivity through the arrangement of the nanofibers. Such a metal nanofiber has significance in that it can provide a solution capable of overcoming the limitation of conventional nanowires.

The process for forming the nanofiber 24_1 is substantially influenced by parameters of the solution 22. The shape of the nanofiber 24_1 generated by electrospinning varies according to the viscosity, surface tension, concentration of the organic substance, molecular weight, and solvent conductivity of the solution 22. Among these, the viscosity of the solution 22 may be the solution parameter having the greatest influence. When the viscosity is too low or too high, beads are formed in the nanofiber 24_1 and cause a shape which is not suitable for a transparent electrode. Furthermore, in order to obtain a shape of the nanofiber suitable for transparent electrodes, conditions should be optimized by adjusting different solution parameters together with viscosity.

On the other hand, in the process of forming the nanofiber 24_1, there are electrospinning process parameters and environmental parameters in addition to the solution parameters. The environmental parameters include humidity and temperature, and since optimal conditions for electric radiation are fixed, ambient parameters may be adjusted by establishing an environment capable of satisfying the optimal conditions.

The parameters that affect the nanofiber 24_1 more directly than the environmental parameters are electrospinning process parameters. The electrospinning process parameters include: the magnitude of a voltage applied by a high voltage source 12; the distance between a tip 11 and a collector 14, and the feeding rate of the solution 22. Among these, the applied voltage is related to electrostatic repulsive force which directly affects the formation of the nanofiber 24_1 in the solution 22. The larger the applied voltage, the further the diameter of the nanofiber 24_1 is reduced, but when the applied voltage becomes too large, instability is caused in the electrospinning itself. Therefore, an optimized nanofiber applicable to transparent electrodes may be formed through the establishment of conditions of the solution parameters and the process parameters.

Meanwhile, in addition to the above-mentioned electrospinning method, various methods are possible as a method of forming the metal precursor-organic nanofiber 24_1. For example, the metal precursor-organic nanofiber 24_1 may be formed by: a direct dispersion method using a solution in which metal particles are dispersed; a gas-solid reaction method using metal ions and inorganic nanoparticles; an in-situ photoreduction method to induce a reduction reaction by irradiating the metal precursor with ultraviolet light; a sol-gel method in which electrospinning and heat treatment are performed to a solution containing a first metal precursor and a second metal precursor; or the like.

Subsequently, the process of performing a selective oxidation heat treatment onto the copper precursor-organic nanofiber, in order to obtain an oxidation-resistant copper-carbon nanofiber by performing one-step heat treatment, will be described. First, before describing the selective oxidation heat treatment method according to the technical idea of the present invention, a two-step heat treatment method in which an oxidation heat treatment and a reduction heat treatment are sequentially configured will be described in comparative example 1, and an auto-reduction heat treatment method for reducing both carbon and oxygen will be hereinafter described in comparative example 2.

Figure 3:
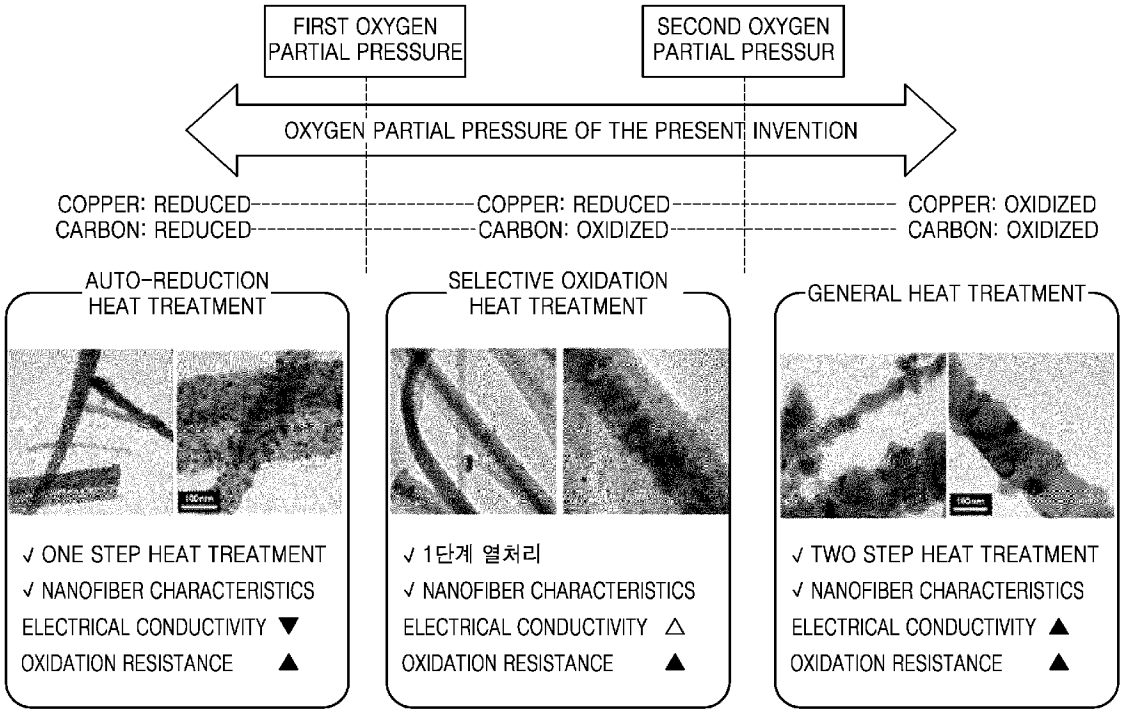
FIG. 3 is a schematic view illustrating concepts of a selective oxidation heat treatment process through an oxygen partial pressure control in one-step heat treatment in a method for producing copper-carbon nanofiber according to some examples of the present invention and a heat treatment process in a method for producing copper-carbon nanofibers according to comparative examples of the present invention.
Figure 4:
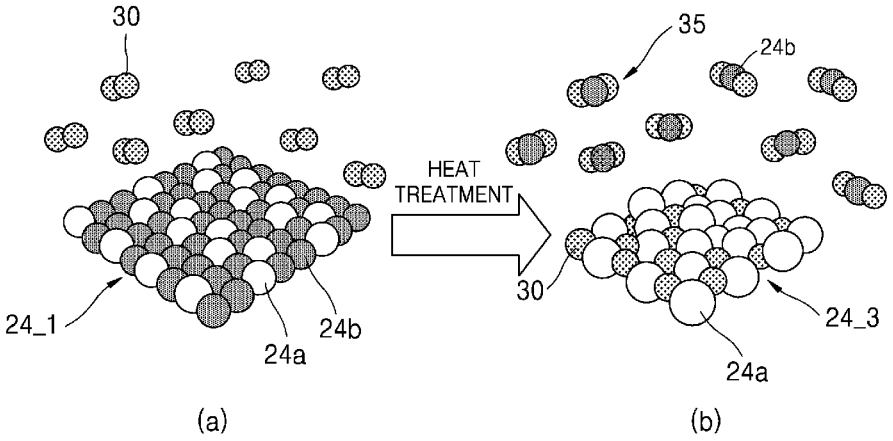
FIG. 4 is a conceptual view illustrating a heat treatment process through an oxygen partial pressure control in two-step heat treatment in a method for producing copper nanofibers according to a comparative example of the present invention.

FIG. 3 schematically illustrates the concepts of a selective oxidation heat treatment process through controlling an oxygen partial pressure in a one-step heat treatment in a method for producing copper-carbon nanofibers according to some examples of the present invention, and a heat treatment process according to a method for producing copper-carbon nanofibers according to comparative examples of the present invention. FIG. 4 is a view conceptually illustrating a heat treatment process through an oxygen partial pressure control in a two-step heat treatment in a method for producing copper nanofibers according to comparative example 1 of the present invention.

Referring to FIGS. 3 and 4, a copper precursor-organic nanofiber 24_1 is a composite nanofiber including copper **24*a* constituting copper acetate, which is a metal precursor, and carbon 24*b* constituting poly vinyl alcohol, which is an organic substance. In order to make the copper precursor-organic nanofiber 24_1** into a copper nanofiber, a subsequent heat treatment process is required.

A heat treatment is performed under an atmosphere including oxygen 30 in order that carbon **24*b* present in the copper precursor-organic nanofiber 24_1 is oxidized and decomposed. Accordingly, the copper 24*a* in the metal precursor is oxidized to form copper oxide (CuO) and the carbon 24*b* in the organic substance is oxidized into a form of the carbon dioxide 35 or the like and is decomposed from the copper precursor-organic nanofibers 24_1. Therefore, a copper oxide (CuO) nanofiber 14_3 is finally formed. This copper oxide nanofiber 24_3** should be again reduced to be formed into a pure copper nanofiber. Therefore, a final copper nanofiber may be produced by performing a heat treatment under a hydrogen ($H_2$) gas atmosphere for reduction.

That is, in order to make metal nanofibers, the two-step heat treatment process of oxidation and reduction is required (FIG. 4 shows only the heat treatment of an oxidation step). The reason for why oxidation and reduction are required is considered as follows. First, oxidation is for removing organic substances **24*b*** including carbon in the form of an organic matrix used to form a nanofiber structure in electrospinning. Hydrogen gas is used to re-reduce the copper oxide formed in this process. The same nanofiber has a problem in that severe damage is caused because being subjected to two stages of heat treatment of oxidation and reduction which are opposite to each other, and furthermore, also in an aspect of production, the process is complicated and manufacturing costs are increased. As a method for solving the problem, an auto-reduction heat treatment method for reducing both carbon and oxygen will be described in comparative example 2 of the present invention, for comparison with an example of the present invention.

Figure 5:
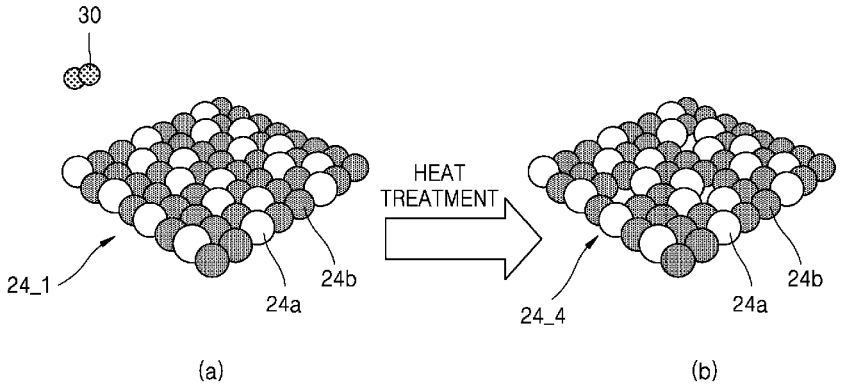
FIG. 5 is a conceptual view illustrating an auto-reduction heat treatment process through an oxygen partial pressure control in one-step heat treatment in a method for producing copper-carbon nanofibers according to a comparative example of the present invention.

FIG. 5 is a conceptual view illustrating an auto-reduction heat treatment process through an oxygen partial pressure control in a one-step heat treatment in a method for producing copper-carbon nanofibers according to comparative example 2 of the present invention.

Referring to FIGS. 3 and 5, comparative example 2 of the present invention is characterized in that the oxygen partial pressure is substantially lowered in the first heat treatment in comparative example 1 so that an auto-reduction is induced under an atmosphere in which oxidation does not occur. The auto-reduction means a heat treatment method for directly reducing into copper 24*a* by using a copper precursor having an acetate functional group such as copper acetate. Such auto-reducible metal, such as copper, nickel, cobalt, and iron, satisfies a condition in which oxidation reactivity is small than carbon. In the present invention, a basic experiment, in which an auto-reduced copper precursor (CuAc) is applied to a producing process of a nanofiber, was performed. When the heat treatment is performed in a state where the oxygen partial pressure is lowered by argon gas below a reference under which copper 24*a* and carbon 24*b* can be oxidized, a portion of the carbon 24*b* is subjected to a pyrolysis reaction and the copper 24*a* constituting a copper precursor is not oxidized into an oxide by auto-reduction, but directly into the copper 24*a*. A copper-carbon nanofiber 24_4 produced through this exhibits an ohmic contact behavior with a constant resistance like a general conductor. However, the copper-carbon nanofibers produced by the auto-reduction compared to the copper nanofibers produced by the two-step heat treatment process in comparative example 1 are not completely decomposed because carbons are not oxidized, and thus have a disadvantage in that electric conductivity is lowered due to the influence of residual carbons.

Figure 6:
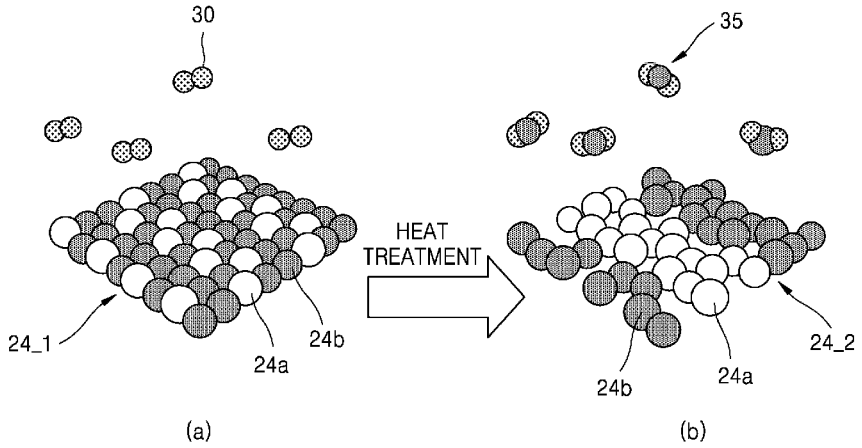
FIG. 6 is a conceptual view illustrating a selective oxidation heat treatment process through an oxygen partial pressure control in one-step heat treatment in a method for producing copper-carbon nanofibers according to some examples of the present invention.

FIG. 6 is a conceptual view illustrating a selective oxidation heat treatment process through an oxygen partial pressure control in a one-step heat treatment in a method for producing copper-carbon nanofibers according to some examples of the present invention.

Referring to FIGS. 3 and 6 together, the selective oxidation heat treatment process according to an example of the present invention is introduced to solve the problems described above. In other words, an example of the present invention provides a method for producing nanofibers having high oxidative stability only through one-step heat treatment process by controlling an oxygen partial pressure during a heat treatment after electrospinning. This is possible by completely understanding and applying the oxidation reactivity and the change of copper and carbon according to oxygen partial pressures. In the existing two-step heat treatment (comparative example 1), in a condition where a heat treatment is performed for oxidation, both copper 24*a* and carbon 24*b* are oxidized. Accordingly, the carbon 24*b* is completely oxidized, but even the copper 24*b* is oxidized, thereby requiring an additional heat treatment for reduction. Since an ordinary copper nanofiber produced by the above process has a crystalline copper exposed directly to the outside, and in particular, since the surface area per volume is large, the oxidation progresses at a very rapid rate.

Conversely, when the oxygen partial pressure is substantially lowered to induce auto-reduction and both the copper 24*a* and the carbon 24*b* are reduced, pure copper may directly be obtained through one-step heat treatment (comparative example 2). However, the carbon 24*b* is oxidized and is not completely decomposed through combustion, but decomposed through a pyrolysis, and therefore, the residual carbons substantially remain at a certain degree. In addition, the nanofiber produced by such a method has a structure in which copper nanoparticles are densely dispersed in amorphous carbons. The electrical conduction in the copper nanoparticles arranged in the amorphous carbon matrix is known to be caused by electron hopping. When the actual resistance was measured, an ohmic contact was found, but the copper-carbon nanofiber 24_4 formed through auto-reduction has a disadvantage in that the amount of residual carbons 24*b* is large, so that electrical resistance thereof is relatively high and conductivity thereof is poor.

Two kinds of subsequent heat treatment methods introduced in the comparative examples are different from the heat treatment method to be presented in one embodiment of the present invention in that both copper and carbon are oxidized or reduced. According to an embodiment of the present invention, a selective oxidation heat treatment method, in which the copper 24*b* is reduced and only the carbon 24*b* is oxidized and decomposed, is provided.

This is substantially significant in that it is possible to take advantages of both the existing heat treatment in the air atmosphere and the heat treatment through auto-reduction. In other words, even while the copper 24*a* is directly reduced through auto-reduction in the one-step heat treatment, the carbon 24*b* may be decomposed through oxidation, thereby reducing the amount of residual carbon 24*b*. Accordingly, a structure is developed in which the copper 24*a* is aggregated in one line in the structure along an axis in the direction parallel to the copper-carbon nanofiber 24_1, and an amorphous carbon 24*b* which acts as an oxidation barrier layer on the surface of the aggregate. A nanofiber may be produced, which has not only the oxidation prevention function which the copper nanofibers obtained in such comparative examples do not have, but also improved electrical conductivity compared to auto-reduction.

In a method for manufacturing a copper-carbon nanofibers according to an example of the present invention, the selective oxidation heat treatment process is performed under an atmosphere of the first oxygen partial pressure to a second oxygen partial pressure atmosphere (i.e., from the first oxygen partial pressure to the second oxygen partial pressure inclusive). When a copper precursor-organic nanofiber 24_1 is heat-treated under an atmosphere of an oxygen partial pressure less than the first oxygen partial pressure, copper 24*a* of a copper precursor is reduced, and carbon 24*b* of an organic substance is also reduced, and when the copper precursor-organic nanofiber 24_1 is heat-treated under an atmosphere of an oxygen partial pressure higher than the second oxygen partial pressure, the copper 24*a* of the copper precursor is oxidized, and the carbon 24*b* of the organic substance is also oxidized. For example, the first oxygen partial pressure may be the oxygen partial pressure corresponding to the oxidation point of the carbon 24*b*, and the second oxygen partial pressure may be the oxygen partial pressure corresponding to the oxidation point of the copper 24*a*.

When the copper precursor-organic nanofiber 24_1 is heat-treated under an atmosphere of the first oxygen partial pressure to the second oxygen partial pressure, the carbon 24*b* in the copper precursor-organic nanofiber 24_1 may be oxidized and residual carbon 24*b* may support a structure of a copper-carbon nanofiber 24_2. However, when the copper precursor-organic nanofiber 24_1 is heat-treated under an atmosphere of an oxygen partial pressure higher than the second oxygen partial pressure, the carbon 24*b* in the copper precursor-organic nanofiber 24_1 may completely be oxidized, so that the structure of the nanofiber is collapsed or even though the nanofiber is formed, copper directly contacts the outside and thus, oxidation resistance of the nanofiber becomes weak.

According to an embodiment of the present invention, provided is a selective oxidation heat treatment method in which the copper 24*a* constituting a copper precursor is reduced by using the fact that oxidation reactivities of the carbon 24*b* and the copper 24 are different, and only the carbon 24*b* constituting an organic substance is oxidized and decomposed, and the method has a substantial significance in that it is possible to take advantages of both the existing heat treatment under the air atmosphere and the heat treatment through auto-reduction.

The copper-carbon nanofiber 24_2 obtained by selective oxidation heat treatment may include a structure formed such that naoparticles of the copper 24*a* is aggregated in one line in the longitudinal direction of the nanofiber inside the nanofiber composed of amorphous carbon 24*b* so as to prevent the oxidation of the copper 24*a*. Furthermore, nanoparticles of the copper 24*a* disposed in the copper-carbon nanofiber 24_2 may be distributed so as to have a relatively higher density inside the nanofiber corresponding to the core portion of the nanofiber and have a relatively lower density in the peripheral portion surrounding the core. In addition, nanoparticles of the copper 24*a* aggregated in one line in the inside (core) of the nanofiber are disposed to be connected to each other, and thus, electrical conductivity characteristic of the nanofiber may be ensured.

Conversely, as in FIG. 5, in the copper-carbon nanofiber 24_4 obtained by the auto-reduction heat treatment, a situation is shown in which nanoparticles of the copper 24*a* do not have a high distribution density in the core of the fiber but have a uniform distribution over the entire fiber. Further, in the copper-carbon nanofiber 24_4 obtained by the auto-reduction heat treatment, relatively more nanoparticles of the copper 24*a* are distributed so as not to be connected to each other, but to be spaced apart from each other. Thus, the copper-carbon nanofiber 24_4 obtained by the auto-reduction heat treatment has a relatively low electrical conductivity than the nanofiber 24_2 which is obtained from the selective oxidation heat treatment and includes nanoparticles of the copper 24*a* aggregated in one line so as to be connected to each other. Accordingly, the copper-carbon nanofiber 24_2 obtained from the selective oxidation heat treatment may have not only the oxidation prevention function which the copper-carbon nanofibers in the comparative examples could not have, but also improved electrical conductivity compared to auto-reduction.

A process for reducing copper in the selective oxidation heat treatment process according to an example of the present invention may include a reaction such as chemical formulas 1 to 4.

$$Cu(CH_3COO)_2 \rightarrow CuCO_3 + CH_3COCH_3 \quad \text{(Chemical formula 1)}$$

$$CuCO_3 \rightarrow CuO + CO_2 \quad \text{(Chemical formula 2)}$$

$$CH_3COCH_3 \rightarrow CO + C_2H_6 \quad \text{(Chemical formula 3)}$$

$$CuO + CO \rightarrow Cu + CO_2 \quad \text{(Chemical formula 4)}$$

Through such reactions, a reducing agent (for example, carbon monoxide (CO)) is automatically generated from acetate and thus, a pure copper phase may be obtained during a heat treatment process.

Hereinafter it will be described from the viewpoint of thermodynamics that the selective oxidation heat treatment process is possible in a method for producing copper-carbon nanofibers according to an example of the present invention.

The reduction of copper acetate (CuAc) which is a metal precursor used in the selective oxidation heat treatment is due to carbon monoxide (CO) which is a reducing agent generated from an acetate functional group in a heat treatment process. That is, since copper is reduced by auto-reduction even in the selective oxidation heat treatment process, the reaction of copper occurring from auto-reduction should be considered to find an oxygen partial pressure required in the heat treatment.

First, when the copper acetate is decomposed, copper oxide (CuO) is formed, and then, the copper oxide is reduced by carbon monoxide (CO). Therefore, the Gibbs free energy for the oxidation reaction of carbon monoxide should be checked in the Ellingham diagram. Since the oxidation reaction of carbon monoxide is not shown actually in the Ellingham diagram, the reaction, in which carbon is oxidized and carbon monoxide and carbon dioxide are thereby formed, should be used. In a reaction in which carbon dioxide is formed, when a reaction, in which carbon monoxide is formed, is reversed and combined, it is possible to find the Gibbs energy in a reaction in which carbon dioxide is actually oxidized under a given temperature and pressure to thereby be formed into carbon dioxide. One point that should be noted is that the slope of the oxidation reactivity graph of carbon monoxide increases as the auto-reduction reaction proceeds. This phenomenon varies according to the ratio of carbon monoxide and carbon dioxide in the Ellingham diagram, and such a behavior appears because carbon monoxide is consumed to thereby be changed into carbon dioxide. In order to find an oxygen partial pressure for performing the selective oxidation heat treatment, Gibbs free energy obtained from a series of processes regarding the oxidation reaction of carbon monoxide is marked on the Ellingham diagram and may then be compared with that in the actual copper oxidation reaction.

Figure 7:
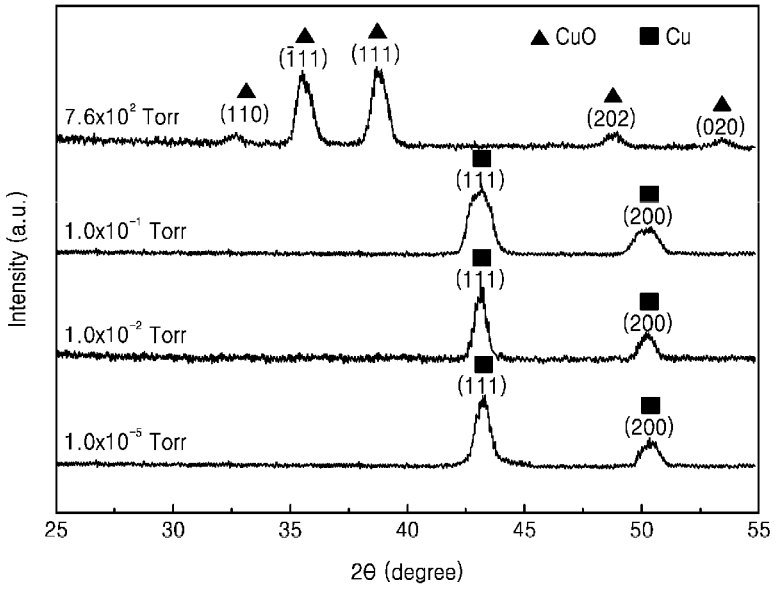
FIG. 7 is a view illustrating phase change pattern of copper in a method for producing copper-carbon nanofibers according to some examples and a comparative example of the present invention.
Figure 8:
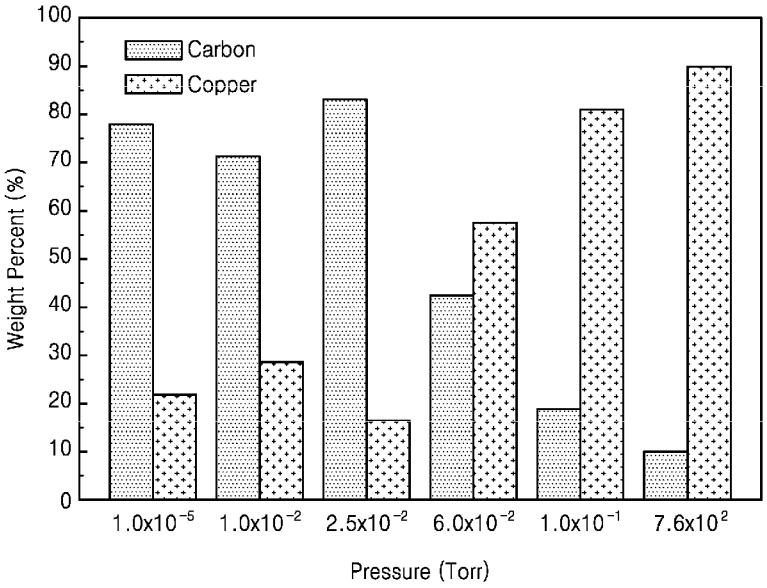
FIG. 8 is a graph illustrating a weight ratio of copper and carbon in a copper-carbon nanofiber produced through a method for producing copper-carbon nanofibers according to some examples and a comparative example of the present invention.

FIG. 7 is a view illustrating a phase change pattern of copper in a method for producing copper-carbon nanofibers according to some examples and comparative examples of the present invention, and FIG. 8 is a graph showing the weight ratio of copper and carbon in copper-carbon nanofibers obtained by a method for manufacturing copper-carbon nanofibers according to some examples and comparative examples of the present invention.

Specifically, FIG. 7 shows characteristics of: copper-carbon nanofibers according to some examples of the present invention formed by performing the selective oxidation heat treatment in an atmosphere of oxygen partial pressures of $1.0\times10^{-2}$ torr, $2.5\times10^{-2}$ torr, $6.0\times10^{-2}$ torr or $1.0\times10^{-1}$ torr within the above-described range from the first oxygen partial pressure to the second oxygen partial pressure; nanofibers according to an comparative example of the present invention formed by performing an auto-reduction heat treatment in an atmosphere of oxygen partial pressures of $1.0\times10^{-2}$ torr less than the first oxygen partial pressure; and nanofibers according to an comparative example of the present invention formed by performing a general heat treatment in an atmosphere of oxygen partial pressures of $7.6\times10^{2}$ torr higher than the second oxygen partial pressure.

Referring to FIG. 7, it may be found that copper is oxidized only in nanofibers formed by performing the general heat treatment in an atmosphere of oxygen partial pressure higher than the second oxygen partial pressure, and copper is not oxidized in nanofibers formed by performing a heat treatment in an atmosphere of oxygen partial pressure less than the second oxygen partial pressure.

Referring to FIG. 8, to analyze the decomposed degree of carbon in the selective oxidation heat treatment, amounts of copper and carbon were measured by using X-ray photoelectron spectroscopy (XPS). It may be found that the region in which main mechanism of carbon decomposition is changed from pyrolysis to combustion is within the range from the first oxygen partial pressure to the second oxygen partial pressure. Meanwhile, in nanofibers formed by performing the general heat treatment in an atmosphere of oxygen partial pressure higher than the second oxygen partial pressure according to the comparative example, it may be found that carbon is mostly decomposed by combustion and the weight ratio of carbon is remarkably reduced.

Meanwhile, the present inventor confirmed that metal-carbon nanofibers having various structures could also be formed according to the magnitude of oxygen partial pressure within the range from first oxygen partial pressure to the second oxygen partial pressure, and hereinafter this will be described in detail.

FIGS. 9 to 12 are views illustrating a mechanism of forming copper-carbon nanofibers in a method for producing copper-carbon nanofibers according to examples of the present invention.

Figure 9:
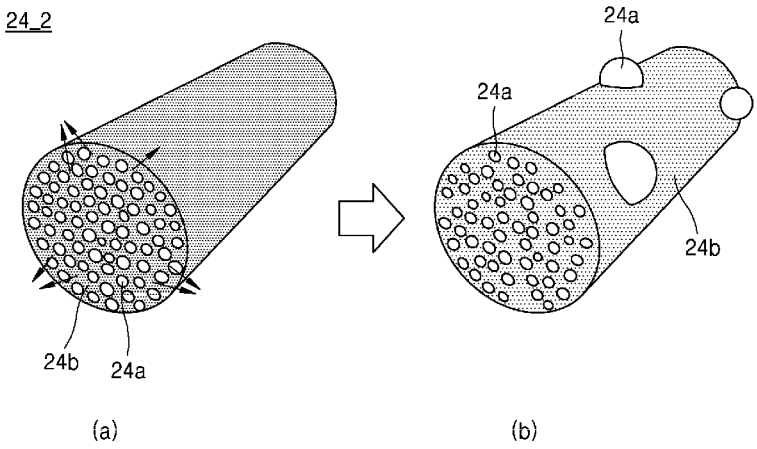
FIG. 9 is a view illustrating a mechanism of forming a copper-carbon nanofiber in a method for producing copper-carbon nanofibers according to a first example of the present invention.

Referring to FIG. 9, disclosed is a copper-carbon nanofiber 24_2 according to a first example of the present invention formed by performing a selective oxidation heat treatment onto the copper precursor-organic nanofiber in an atmosphere of a third oxygen partial pressure (for example, $1.0\times10^{-2}$ torr) which is greater than or equal to the first oxygen partial pressure and less than the second oxygen partial pressure.

When the metal precursor-organic nanofiber is heat-treated in an atmosphere of an oxygen partial pressure greater than or equal to the third oxygen partial pressure, a hollow hole (H of FIGS. 10 to 12) is formed inside the copper-carbon nanofiber by the diffusion of carbon according to a concentration gradient of residual carbons which remain after carbons in the copper precursor-organic nanofiber are oxidized. Oxidation of carbon further occurs in the outer surface than the core of the copper-carbon nanofiber, and the carbon concentration in the outer surface is less than that in the core, and therefore, carbon is more actively diffused toward the outside of the nanofiber, and thus, the hollow hole H is formed.

The copper-carbon nanofiber 24_2 according to a first example of the present invention, formed by performing a selective oxidation heat treatment onto the copper precursor-organic nanofiber 24_1 in an atmosphere of an oxygen partial pressure which is greater than or equal to the first oxygen partial pressure and less than the third oxygen partial pressure, may be composed of particles of copper 24*a* and carbon body 24*b*. The carbon body 24*b* is present in a fiber shape having no hollow hole therein, and the particles of copper 24*a* may be uniformly distributed inside the base material of the carbon body 24*b* and on the outer surface of the carbon body 24*b*. In particular, the copper-carbon nanofiber 24_2 illustrated in (b) of FIG. 9 is formed such that in the copper-carbon nanofiber 24_2 illustrated in (a) of FIG. 9, copper 24*a* is diffused from the core of the copper-carbon nanofiber 24_2 toward the outer surface thereof. Such diffusion is caused because stress due to the difference in thermal expansion coefficients of copper and carbon is mitigated.

Figure 10:
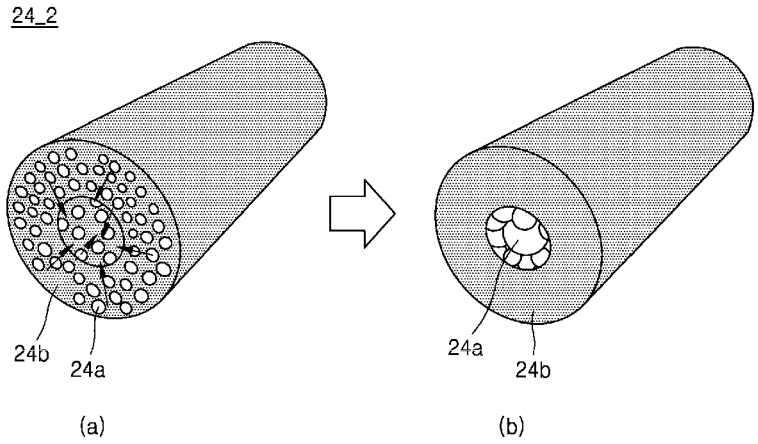
FIG. 10 is a view illustrating a mechanism of forming a copper-carbon nanofiber in a method for producing copper-carbon nanofibers according to a second example of the present invention.

Referring to FIG. 10, disclosed is a copper-carbon nanofiber 24_2 according to a second example of the present invention formed by performing a selective oxidation heat treatment onto the copper precursor-organic nanofiber in an atmosphere of a fourth oxygen partial pressure which is greater than or equal to the third oxygen partial pressure and less than the second oxygen partial pressure (e.g., $2.5\times10^{-2}$ torr).

When the copper precursor-organic nanofiber is heat-treated in an atmosphere of oxygen partial pressure greater than or equal to the fourth oxygen partial pressure, a hollow hole (H of FIGS. 11 to 12) is formed inside the copper-carbon nanofiber according to a concentration gradient of residual carbons which remain after carbons in the copper precursor-organic nanofiber are oxidized, and the copper 24*a* in the copper-carbon nanofiber may be diffused not only to the core of the copper-carbon nanofiber but also to the outer surface thereof.

The copper-carbon nanofiber 24_2 according to the second example of the present invention formed by performing a selective oxidation heat treatment onto the copper precursor-organic nanofiber 24_1 in an atmosphere of an oxygen partial pressure greater than or equal to a third oxygen partial pressure and less than the fourth oxygen partial pressure has a core-shell structure in which the particles of copper 24*a* form a core of the nanofiber and carbon 24*b* forms a shell surrounding the particles of copper 24*a*. In particular, the copper-carbon nanofiber 24_2 illustrated in (b) of FIG. 10 is formed such that in the copper-carbon nanofiber 24_2 illustrated in (a) of FIG. 10, copper 24*a* is diffused toward the core of the copper-carbon nanofiber 24_2. Such diffusion is caused because stress due to the difference in thermal expansion coefficients of copper and carbon is mitigated. In addition, among the particles of copper, changes from small particles into large particles are observed, which can be understood as so-called Ostwald ripening phenomenon.

Figure 11:
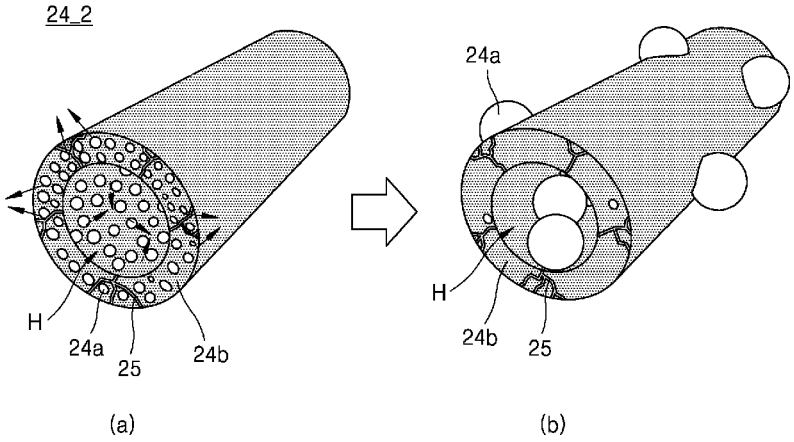
FIG. 11 is a view illustrating a mechanism of forming copper-carbon nanofibers in a method for producing copper-carbon nanofibers according to a third example of the present invention.

Referring to FIG. 11, disclosed is a copper-carbon nanofiber 24_2 according to a third example of the present invention formed by performing a selective oxidation heat treatment onto the copper precursor-organic nanofiber in an atmosphere of a fifth oxygen partial pressure which is greater than or equal to the fourth oxygen partial pressure and less than the second oxygen partial pressure (e.g., $5.0\times10^{-2}$ torr).

Figure 12:
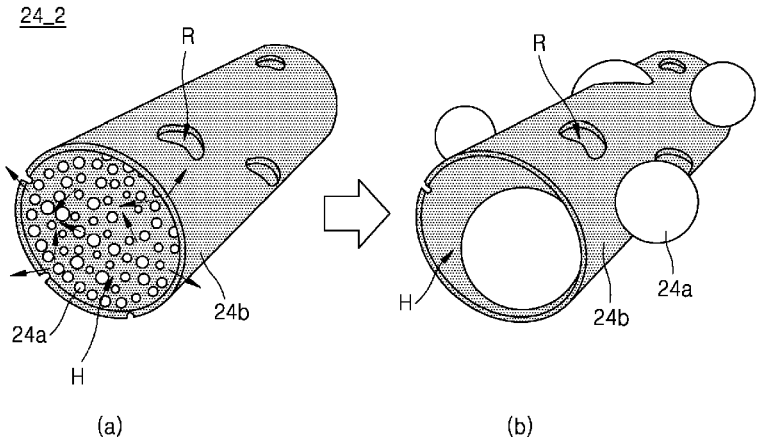
FIG. 12 is a view illustrating a mechanism of forming copper-carbon nanofibers in a method for producing copper-carbon nanofibers according to a fourth example of the present invention.

When the copper precursor-organic nanofiber is heat-treated in an atmosphere of oxygen partial pressure greater than the fifth oxygen partial pressure, a hollow hole (H of FIG. 12) is formed inside the copper-carbon nanofiber according to a concentration gradient of residual carbons which remain after carbons in the copper precursor-organic nanofiber are oxidized, and a portion of the outer surface of the copper-carbon nanofiber may be thinned and ruptured (R of FIG. 12).

The copper-carbon nanofiber 24_2 according to the third example of the present invention formed by performing a selective oxidation heat treatment on the copper precursor-organic nanofiber in an atmosphere of an oxygen partial pressure, which is greater than or equal to the fourth oxygen partial pressure and less than the fifth oxygen partial pressure, may have a structure in which the particles of copper 24*a* are distributed inside a base material of a tubular carbon body 24*b* that defines the hollow hole H, on the outer surface of the carbon body 24*b*, and inside the hollow hole H. In this case, the tubular carbon body 24*b* defining the hollow hole H has a thickness of a degree in which the particles of copper 24*a* may be disposed.

In particular, the copper-carbon nanofiber 24_2 illustrated in (b) of FIG. 11 is formed such that in the copper-carbon nanofiber 24_2 illustrated in (a) of FIG. 11, copper 24*a* is diffused toward the core of the copper-carbon nanofiber 24_2 or toward the outer surface thereof. Such diffusion is caused because stress due to the difference in thermal expansion coefficients of copper and carbon is mitigated. Further, such diffusion may also be performed through nanochannels 25 formed inside the base material of the tubular carbon body 24*b*. In addition, due to so-called Ostwald ripening phenomenon, changes from a small particle into a large particle may be observed.

Referring to FIG. 12, disclosed is a copper-carbon nanofiber 24_2 according to a fourth example of the present invention formed by performing a selective oxidation heat treatment onto the copper precursor-organic nanofiber in an atmosphere of oxygen partial pressures which is greater than or equal to the fifth oxygen partial pressure and less than the second oxygen partial pressure (e.g., $6.0\times10^{-2}$ torr).

The copper-carbon nanofiber 24_2 according to the fourth example of the present invention formed by performing the selective oxidation heat treatment on the copper precursor-organic nanofiber in an atmosphere of an oxygen partial pressure, which is greater than or equal to the fifth oxygen partial pressure and less than the second oxygen partial pressure, may have a structure in which the particles of copper 24*a* are distributed on the outer surface and inside the hollow hole H of a tubular carbon body 24*b* that defines the hollow hole H. In this case, the tubular carbon body 24*b* defining the hollow hole H cannot ensure a thickness of a degree in which the particles of copper 24*a* may be disposed, and a portion of the outer surface thereof may be thinned and ruptured R.

In particular, the copper-carbon nanofiber 24_2 illustrated in (b) of FIG. 12 is formed such that in the copper-carbon nanofiber 24_2 illustrated in (a) of FIG. 12, copper 24*a* is diffused toward the core or toward the outer surface of the copper-carbon nanofiber 24_2. Such diffusion is caused because stress due to the difference in thermal expansion coefficients of copper and carbon is mitigated. Further, such diffusion may also be performed through nanochannels formed inside the base material of the tubular carbon body 24*b*. In addition, due to so-called Ostwald ripening phenomenon, changes from a small particle into a large particle may be observed.

Figure 13:
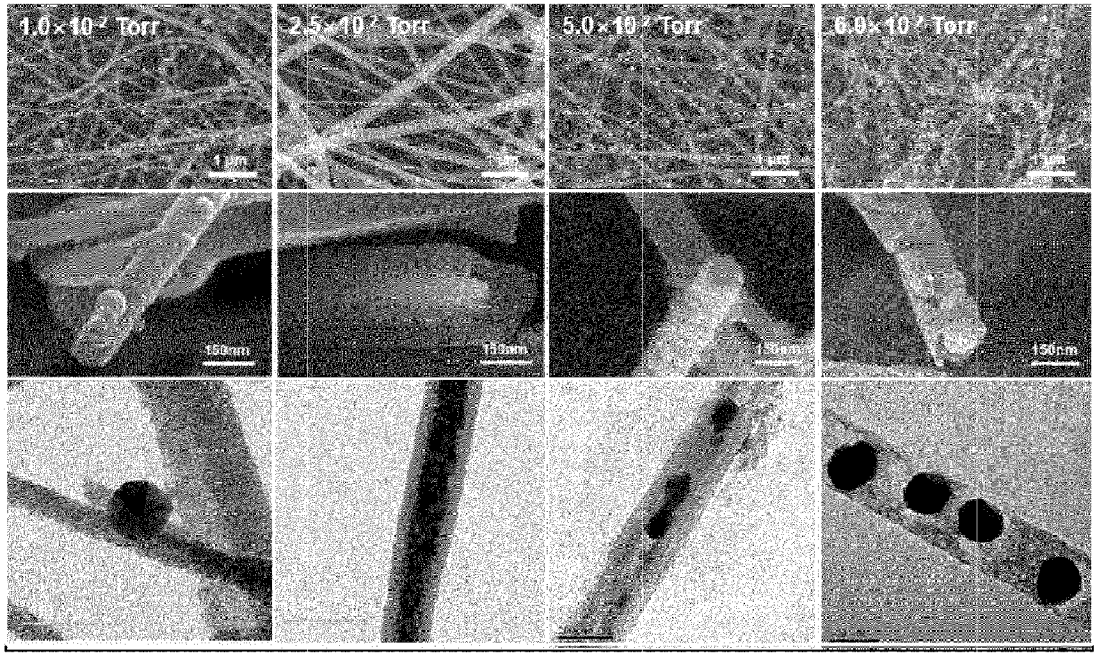
FIG. 13 illustrates photographs of copper-carbon nanofibers obtained by a method for producing copper-carbon nanofibers according to some examples of the present invention.

FIG. 13 illustrates photographs of copper-carbon nanofibers obtained by a method for producing copper-carbon nanofibers according to some examples of the present invention. Specifically, (a) of FIG. 13 shows photographs imaging the copper-carbon nanofiber 24_2 according to the first example of the present invention formed by performing a selective oxidation heat treatment on the copper precursor-organic nanofiber 24_1 in an atmosphere of an oxygen partial pressure of $1.0\times10^{-2}$ torr which is greater than or equal to the first oxygen partial pressure and less than the third partial pressure; (b) of FIG. 13 shows photographs imaging the copper-carbon nanofiber 24_2 according to the second example of the present invention formed by performing a selective oxidation heat treatment on the copper precursor-organic nanofiber 24_1 in an atmosphere of an oxygen partial pressure of $2.5\times10^{-2}$ torr which is greater than or equal to the third oxygen partial pressure and less than the fourth partial pressure; (c) of FIG. 13 shows photographs imaging the copper-carbon nanofiber 24_2 according to the third example of the present invention formed by performing the selective oxidation heat treatment on the copper precursor-organic nanofiber 24_1 in an atmosphere of an oxygen partial pressure of $5.0\times10^{-2}$ torr which is greater than or equal to the fourth oxygen partial pressure and less than the fifth partial pressure; and (d) of FIG. 13 shows photographs imaging the copper-carbon nanofiber 24_2 according to the fourth example of the present invention formed by performing the selective oxidation heat treatment on the copper precursor-organic nanofiber 24_1 in an atmosphere of an oxygen partial pressure of $6.0\times10^{-2}$ torr which is greater than or equal to the fifth oxygen partial pressure and less than the second partial pressure. The structures of these nanofibers have been described above in detail and will not be provided herein.

Figure 14:
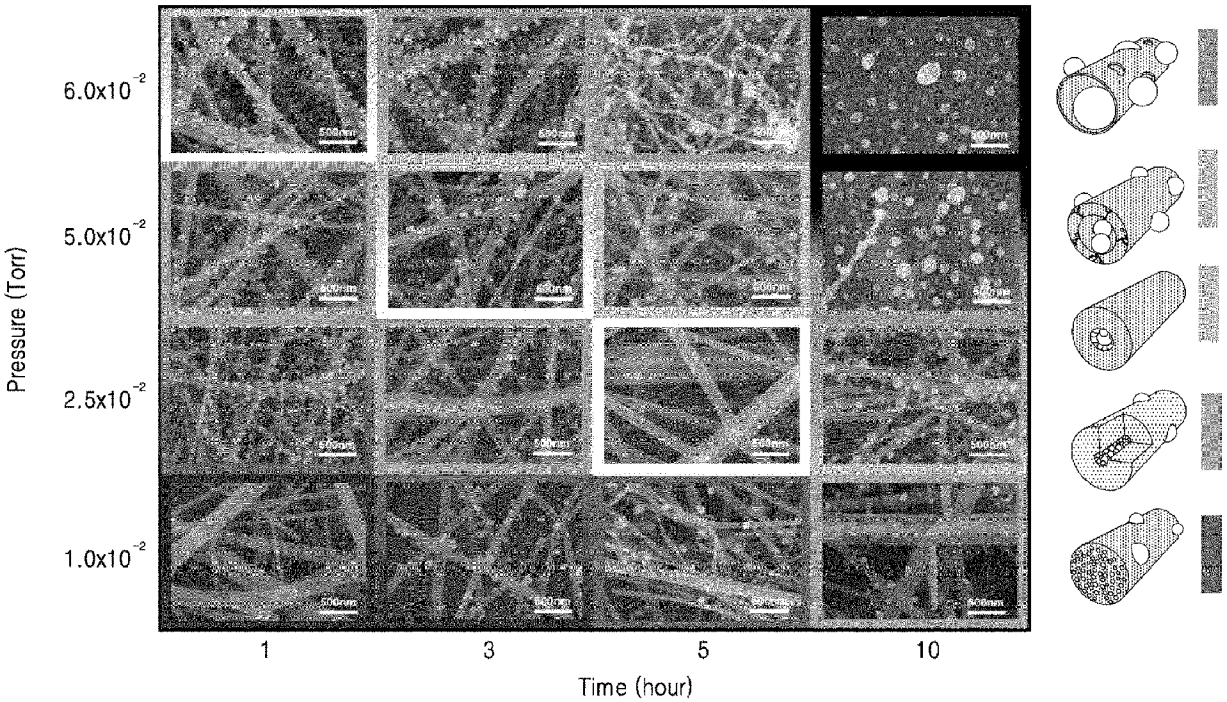
FIG. 14 illustrates photographs of copper-carbon nanofibers obtained by a method for producing copper-carbon nanofibers by using process parameters of pressure and time according to some examples of the present invention.

FIG. 14 illustrates structure formation patterns according to pressures and time of the selective oxidation heat treatment. According to these, nanofibers may be formed into a first structure (e.g., the structure disclosed in FIG. 9), a second structure (e.g., the structure disclosed in FIG. 10), a third structure (e.g., the structure disclosed in FIG. 11), and a fourth structure (e.g., the structure disclosed in FIG. 12), in said order. In the first structure, metal particles are uniformly distributed inside the base material and the outer surface of a fibrous carbon body without a hollow hole even when the heat treatment time is lengthened under a constant pressure. The second structure has a core-shell structure in which metal particles form a core and carbon forms a shell. In the third structure, metal particles are distributed inside a base material and on the surface of the tubular carbon body defining a hollow hole, and inside the hollow hole. In the fourth structure, a hollow hole is formed inside the nanofiber, a portion of the outer surface of the metal-carbon nanofiber is thinned and ruptured, and metals are distributed on the outer surface of a carbon body and inside the hollow hole.

For example, in performing the selective oxidation heat treatment on the copper precursor-organic nanofiber in an atmosphere of an oxygen partial pressure of $2.5\times10^{-2}$ torr which is greater than or equal to the third oxygen partial pressure and less than the fourth oxygen partial pressure, it may be confirmed that at least a portion of the copper-carbon nanofibers having the first structure to the fourth structure are sequentially formed according to heat treatment time.

Of course, this tendency may vary in formation rates according to pressures. The hollow hole is formed with a higher rate under a high pressure, and thus, the higher the pressure, the quicker the four structures from the first structure to the fourth structure are formed in the metal-carbon nanofibers. This is because the higher the pressure, the more the amount of decomposed carbon for the same time period, a concentration gradient is increased, so that the amount of carbon diffused to the outside increases, and the hollow holes are more quickly formed.

Figure 15:
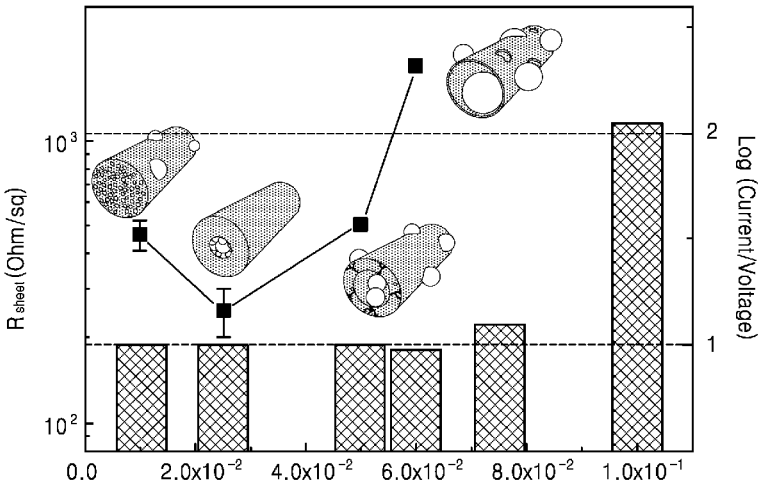
FIG. 15 is a view illustrating a resistance pattern according to an oxygen partial pressure in selective oxidation heat treatment using oxygen gas in a method for producing copper-carbon nanofibers according to some examples of the present invention

FIG. 15 is a view illustrating a resistance pattern according to an oxygen partial pressure in a selective oxidation heat treatment using oxygen gas in a method for producing copper-carbon nanofibers according to some examples of the present invention.

Referring to FIG. 15, the lowest surface resistance pattern appears in the copper-carbon nanofiber according to the second example of the present invention formed by performing the selective oxidation heat treatment on the copper precursor-organic nanofiber 24_1 in an atmosphere of an oxygen partial pressure of $2.5\times10^{-2}$ torr which is greater than or equal to the third oxygen partial pressure and less than the fourth partial pressure. It is understood that this is because particles of copper 24*a* have a conductive structure concentratedly aggregated aligned in one row in the core of the nanofiber.

Figure 16:
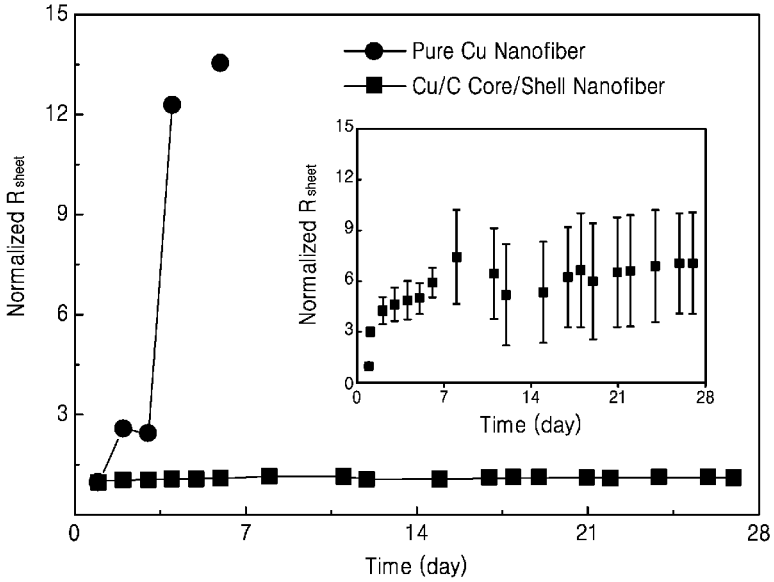
FIG. 16 is a view illustrating an evaluation result of oxidation resistance of nanofibers formed through selective oxidation heat treatment in a method for producing copper-carbon nanofibers according to an example of the present invention.

FIG. 16 is a view illustrating an evaluation result of oxidation resistance of copper-carbon nanofibers formed through a selective oxidation heat treatment in a method for producing copper-carbon nanofibers according to the second example of the present invention.

Referring to FIG. 16, the oxidation resistance was evaluated for the copper-carbon nanofiber according to the second example of the present invention formed by performing the selective oxidation heat treatment on the copper precursor-organic nanofiber 24_1 in an atmosphere of an oxygen partial pressure of $2.5\times10^{-2}$ torr which is greater than or equal to the third oxygen partial pressure and less than the fourth partial pressure. The evaluation was performed under the condition of performing under the room temperature and the air atmosphere, which are similar to use conditions of general elements, such that surface resistance had been measured for 28 days and changes were observed. A copper nanofiber used in existing arts was used as a control group.

As a result of observing the change in resistance due to oxidation of copper in the two nanofibers, it could be found that unlike the copper nanofiber set as the control group, in the copper-carbon nanofiber, resistance increased only up to a range of approximately 10% for 28 days. In the case of the copper nanofiber previously set as the control group, resistance increased at very high rate and increased up to approximately 12 times the existing resistance.

In addition to the control group, the result was compared with research data in which oxidation is prevented by forming a coating film using an atomic layer deposition (ALD) method to prevent the oxidation of the copper nanofiber. Also in this experimental example, oxidation was performed under the same room temperature, the atmospheric pressure, and the air atmosphere, and in this case, pure copper nanofiber showed a result in which resistance increased by 60% after 28 days. Therefore, even when the control groups were checked, it could be determined that the copper-carbon nanofiber according to an example of the present invention certainly had oxidation prevention performance.

The case of a copper-carbon nanofiber according to an example of the present invention has remarkable significance in that an oxidation preventing film is formed from PVA added in a solution for producing a nanofiber structure. The case in which an external film is formed through the ALD method for oxidation resistance is inefficient in that a process is further added and also inefficient in terms of material. However, the methods provided in the present examples have significance in that a carbon film of the nanofiber formed through electrospinning is not completely decomposed but adjusted into a structure and a thickness efficient for oxidation prevention through the selective oxidation heat treatment.

The copper-carbon (Cu—C) nanofiber formed through the one-step heat treatment has significant importance in that a very serious problem of oxidation caused by a material of copper in the existing art is simply solved. In addition, unlike adding a new process by providing a coating film from the outside to solve the oxidation problem in existing arts, the material required to produce a nanofiber is reused to impart oxidation resistance to the nanofiber in this method, and from this point, the technique may be applied to various fields in which copper is currently used as an electrode.

In addition, as described above, it was confirmed that metal-carbon nanofibers having various structures could be formed according to the magnitude of oxygen partial pressure within the range from the first oxygen partial pressure to the second oxygen partial pressure, and thus, the metal-carbon nanofiber may be applied to various application fields according to the structures thereof.

For example, as illustrated in FIG. 9, the metal-carbon nanofiber 24_2 having a structure, in which metal particles 24*a* such as nickel, cobalt or iron are uniformly distributed in the base material and on the outer surface of the carbon body 24*b*, may be applied to an energy field such as a battery.

For example, as illustrated in FIG. 10, the metal-carbon nanofiber 24_2 having a core-shell structure, in which metal particles 24*a* such as copper form a core and carbon 24*b* forms a shell surrounding the metal particles 24*a*, may be applied to electronic products using transparent electrodes.

For example, as illustrated in FIG. 11, the metal-carbon nanofiber 24_2 having a structure, in which particles of copper, zinc oxide, or aluminum oxide are distributed in the base material and on the outer surface of the tubular carbon body 24*b* which defines a hollow hole H, and in the hollow hole H, may be applied to an environmental field for reducing carbon dioxide.

For example, as illustrated in FIG. 12, the metal-carbon nanofiber 24_2 having a structure, in which particles of copper or palladium are distributed on the outer surface of the tubular carbon body 24*b*, which defines a hollow hole H, and in the hollow hole H, may be applied to a chemical field for sensing gas.

The description of the present invention is intended to be illustrative, and those with ordinary skill in the technical field of the present invention pertains will be understood that the present invention can be carried out in other specific forms without changing the technical idea or essential features. Hence, the real protective scope of the present invention shall be determined by the technical scope of the accompanying claims.

The invention claimed is:

1. A method for producing a metal-carbon nanofiber, the method comprising the steps of:

forming a metal precursor-organic nanofiber comprising a metal precursor and an organic substance; and forming a metal-carbon nanofiber by performing a selective oxidation heat treatment onto the metal precursor-organic nanofiber such that carbons in the organic substance are oxidized and the metal precursor is reduced into a metal, wherein the metal has a lower oxidation reactivity than carbon;

the selective oxidation heat treatment is performed not in a plurality of heat treatment steps but in one heat treatment step; and the metal-carbon nanofibers having structures different from each other are able to be produced according to oxygen partial pressures and/or time for performing the selective oxidation heat treatment.

2. The method of claim 1, wherein the metal comprises copper, nickel, cobalt, iron, or silver which is a metal having lower oxidation reactivity than carbon.

3. The method of claim 1, wherein the selective oxidation heat treatment is performed in an atmosphere having an oxygen partial pressure between of a first oxygen partial pressure and a second oxygen partial pressure;

if the metal precursor-organic nanofiber is heat treated in an atmosphere of an oxygen partial pressure less than the first oxygen partial pressure, metals of the metal precursor are reduced and carbons of the organic substance are also reduced; and if the metal precursor-organic nanofiber is heat treated in an atmosphere of an oxygen partial pressure higher than the second oxygen partial pressure, metals of the metal precursor are oxidized and carbons of the organic substance are also oxidized.

4. The method of claim 3, wherein when the metal precursor-organic nanofiber is heat-treated in an atmosphere having an oxygen partial pressure between the first oxygen partial pressure and the second oxygen partial pressure, carbons in the metal precursor-organic nanofiber are oxidized and remaining carbons support a structure of the metal precursor-organic nanofiber; and if the metal precursor-organic nanofiber is heat-treated in an atmosphere of a higher oxygen partial pressure than the second oxygen partial pressure, carbons in the metal precursor-organic nanofiber are oxidized and remaining carbons do not support the structure of the metal precursor-organic nanofiber.

5. The method of claim 3, wherein the selective oxidation heat treatment is performed in an atmosphere of an oxygen partial pressure less than a third oxygen partial pressure which is greater than or equal to the first oxygen partial pressure and less than the second oxygen partial pressure; and if the metal precursor-organic nanofiber is heat treated in an atmosphere of an oxygen partial pressure greater than or equal to the third oxygen partial pressure, a hollow hole is generated inside the metal-carbon nanofiber by diffusion of carbons according to a concentration gradient of residual carbons which remain after carbons in the copper precursor-organic nanofiber are oxidized; and if the metal-carbon nanofiber formed by performing the selective oxidation heat treatment in an atmosphere of an oxygen partial pressure which is greater than or equal to the first oxygen partial pressure and less than the third oxygen partial pressure has a structure in which metal particles are uniformly distributed inside a base material and on an outer surface of a fibrous carbon body without a hollow hole.

6. The method of claim 3, wherein the selective oxidation heat treatment is performed in an atmosphere of an oxygen partial pressure less than a fourth oxygen partial pressure which is greater than or equal to a third oxygen partial pressure and less than the second oxygen partial pressure, the third oxygen partial pressure being greater than or equal to the first oxygen partial pressure and less than the second oxygen partial pressure; and if the metal precursor-organic nanofiber is heat treated in an atmosphere of an oxygen partial pressure greater than or equal to the fourth oxygen partial pressure, a hollow hole is generated inside the metal-carbon nanofiber by diffusion of carbons according to a concentration gradient of residual carbons which remain after carbons in the copper precursor-organic nanofiber are oxidized, and metals in the metal-carbon nanofiber are diffused not only to a core but also to an outer surface of the metal-carbon nanofiber; and if the metal-carbon nanofiber formed by performing the selective oxidation heat treatment in an atmosphere of an oxygen partial pressure, which is greater than or equal to the third oxygen partial pressure and less than the fourth oxygen partial pressure, has a core-shell structure in which metal particles form the core and carbons form a shell surrounding the core.

7. The method of claim 3, wherein the selective oxidation heat treatment is performed in an atmosphere of an oxygen partial pressure less than a fifth oxygen partial pressure which is greater than or equal to a fourth oxygen partial pressure and less than the second oxygen partial pressure, the fourth oxygen partial pressure being greater than or equal to a third oxygen partial pressure and less than the second oxygen partial pressure, and the third oxygen partial pressure being greater than or equal to the first oxygen partial pressure and less than the second oxygen partial pressure; and if the metal precursor-organic nanofiber is heat treated in an atmosphere of an oxygen partial pressure greater than or equal to the fifth oxygen partial pressure, a hollow hole is generated inside the metal-carbon nanofiber by diffusion of carbons according to a concentration gradient of residual carbons which remain after carbons in the copper precursor-organic nanofiber are oxidized, and a portion of an outer surface of the metal-carbon nanofiber is thinned and ruptured; and if the metal-carbon nanofiber formed by performing the selective oxidation heat treatment in an atmosphere of an oxygen partial pressure, which is greater than or equal to the fourth oxygen partial pressure and less than the fifth oxygen partial pressure, has a structure in which metal particles are distributed inside a base material and an outer surface of a tubular carbon body defining the hollow hole, and inside the hollow hole.

8. The method of claim 3, wherein the selective oxidation heat treatment is performed in an atmosphere of an oxygen partial pressure which is greater than or equal to a fifth oxygen partial pressure and less than the second oxygen partial pressure, the fifth oxygen partial pressure being greater than or equal to a fourth oxygen partial pressure and less than the second oxygen partial pressure, the fourth oxygen partial pressure being greater than or equal to a third oxygen partial pressure and less than the second oxygen partial pressure, and the third oxygen partial pressure being greater than or equal to the first oxygen partial pressure and less than the second oxygen partial pressure; and the metal-carbon nanofiber formed by performing the selective oxidation heat treatment on the metal precursor-organic nanofiber in an atmosphere of an oxygen partial pressure, which is greater than or equal to the fifth oxygen partial pressure and less than the second oxygen partial pressure, has a structure in which carbons in the metal precursor-organic nanofiber is oxidized, a hollow hole is formed by a concentration gradient of remaining carbons, a portion of an outer surface of the metal-carbon nanofiber is thinned and ruptured, and metals are distributed in an outer surface of a carbon body and in the hollow hole.

9. The method of claim 1, wherein, based on a time period during which the selective oxidation heat treatment is performed:

a structure in which metal particles are uniformly distributed inside the base material and the outer surface of a fibrous carbon body without a hollow hole;

a core-shell structure in which metals form a core and carbons form a shell surrounding the metals;

a structure in which metal particles are distributed inside a base material and on the surface of the tubular carbon body defining a hollow hole, and inside the hollow hole; and a structure, in which a hollow hole is formed inside a nanofiber, a portion of the outer surface of the metal-carbon nanofiber is thinned and ruptured, and metals are distributed on the outer surface of a carbon body and inside the hollow hole, are sequentially formed.

10. The method of claim 9, wherein while the selective oxidation heat treatment is performed, the oxygen partial pressure is constant.

11. The method of claim 1, wherein the metal precursor comprises copper acetate (Cu(CH3COO)2) which is a copper precursor, and the organic substance comprises polyvinylalcohol (PVA) forming a hydrogen bond with the copper acetate.

12. The method of claim 11, wherein the step of forming a metal-carbon nanofiber by performing the selective oxidation heat treatment onto the metal precursor-organic nanofiber such that carbons in the organic substance are oxidized and the metal precursor is reduced into a metal comprises a step of performing auto-reduction onto the copper precursor using, as a reducing agent, carbon monoxide (CO) generated from an acetate functional group of the copper precursor by the selective oxidation heat treatment.

13. The method of claim 1, wherein the step of forming a metal-carbon nanofiber by performing the selective oxidation heat treatment onto the metal precursor-organic nanofiber comprises a step of decomposing a portion of carbons constituting the metal precursor-organic nanofiber not by pyrolysis but by combustion.

14. A metal-carbon nanofiber obtained by the method of according to claim 1.

* * * * *